US006296348B1

(12) United States Patent
Shibata

(10) Patent No.: US 6,296,348 B1
(45) Date of Patent: Oct. 2, 2001

(54) DIRECT RECORDING APPARATUS WITH CONTROLLING SECTION TO ADJUST VOLTAGE AMONG DISCHARGE ELECTRODES

(75) Inventor: Yoshifumi Shibata, Toyokawa (JP)

(73) Assignee: Array Printers AB, Vastra (SE)

( * ) Notice: Subject to any disclaimer, the term of this patent is extended or adjusted under 35 U.S.C. 154(b) by 0 days.

(21) Appl. No.: 09/465,320

(22) Filed: Dec. 17, 1999

(30) Foreign Application Priority Data

Jan. 25, 1999 (JP) ..... 11-015533

(51) Int. Cl.[7] ..... B41J 2/06
(52) U.S. Cl. ..... 347/55; 347/54
(58) Field of Search ..... 347/55, 54, 20

(56) References Cited

U.S. PATENT DOCUMENTS 5,477,250 12/1995 Larson ..... 347/55
5,767,879 * 6/1998 Tsukamoto et al. ..... 347/55
5,984,456 * 11/1999 Bern ..... 347/55
6,132,029 * 10/2000 Bern ..... 347/55
6,174,048 * 1/2001 Bern ..... 347/55

* cited by examiner

*Primary Examiner*—Thinh Nguyen
*Assistant Examiner*—Matthew T. Welker
(74) *Attorney, Agent, or Firm*—Morrison & Foerster LLP

(57) ABSTRACT

Negatively charged toner particles on a record roller are attracted by a back electrode. When a first voltage is applied to a first electrode of a printed circuit board when this condition is present, the toner particles on the record roller are attracted more strongly so that they will jump toward a aperture in the printed circuit board. As the first voltage applied to the first electrode of the printed circuit board is turned off, a control section causes the potential difference between a second electrode and the back electrode to become smaller.

5 Claims, 4 Drawing Sheets

DIRECT RECORDING APPARATUS WITH CONTROLLING SECTION TO ADJUST VOLTAGE AMONG DISCHARGE ELECTRODES

BACKGROUND OF THE INVENTION

1. Field of the Invention

The present invention relates to an apparatus which records an image on a recording sheet by causing recording particles to jump and then directly depositing the particles on the recording sheet such as a paper sheet.

2. Description of the Related Art

A recording apparatus is disclosed in U.S. Pat. No. 5,477,250. The recording apparatus has a rotatable cylindrical toner carrier which holds charged toner particles on the outer peripheral surface thereof, and a back electrode which is disposed with a gap from the toner carrier. The back electrode is electrically connected to a power source to form an electric field which electrostatically attracts the charged toner particles on the toner carrier toward the back electrode. An insulating plate having a plurality of apertures through which toner particles can pass is placed between the toner carrier and the back electrode. The insulating plate has annular electrodes which surround the apertures, respectively.

In the recording apparatus, when a voltage corresponding to an image data is applied to one of the electrodes, the toner particles in a position on the toner carrier where is opposed to the electrode are peeled off to jump into the corresponding aperture. The toner particles which have passed through the aperture are deposited on a recording sheet to form a dot. An image corresponding to the image data is recorded on the recording sheet by a mass of such dots.

In the recording apparatus, a cluster of toner particles which jump from the toner carrier is dispersed during a period when the toner particles pass through the aperture, and hence a dot formed on the recording sheet has an obscure outline and a low density. As a result, there arises the problem in that a formed image lacks sharpness. In order to solve the problem, a method has been proposed in which a converging electrode is disposed in the periphery of the aperture in the insulating plate and on the side of the back electrode with respect to the annular electrode, a constant voltage of the same polarity as that of the charged toner particles is applied to the converging electrode, and a cluster of toner particles which pass through the aperture is inwardly converged in a radial direction by an electric repulsive force, whereby a dense dot having a sharp outline is formed on the recording sheet.

However, a recording apparatus provided with such a converging electrode has the other problem in that the jumping toner particles are accelerated by an electric field formed between the converging electrode and the back electrode, and the toner particles are scattered by an impact at the collision with the recording sheet, whereby the image quality is deteriorated.

SUMMARY OF THE INVENTION

In order to solve the other problem, the direct recording apparatus of the present invention comprises:

a carrier which holds charged recording particles;

a back electrode which is opposed to the carrier to electrostatically attract the recording particles;

a PC board which is placed between the carrier and the back electrode so as to form a passage through which an image carrier passes between the back electrode and the PC board, the PC board being made of an insulating material and having a plurality of apertures through which the recording particles can pass;

a first electrode which is placed around each of the apertures in the PC board, and which, when the first voltage is applied, more strongly attracts the recording particles held on the carrier toward the back electrode and causes them to jump into the aperture;

a second electrode which is placed around each of the aperture in the PC board and on the side of the back electrode with respect to the first electrode, and which, when the second voltage is applied, converges a cluster of the recording particles passing through the aperture by an electric repulsive force, or changes a jumping direction of a cluster of the recording particles passing through the aperture; and a control section which, in correspondence with turning off of the first voltage applied to the first electrode, controls a potential difference between the second electrode and the back electrode to become smaller.

It is to be noted that the term "in correspondence with" means not only the case where the operations are completely synchronized with each other, but also the case where they are slightly shifted in timing from each other.

In the direct recording apparatus of the present invention, in correspondence with turning off of the first voltage applied to the first electrode, a potential of the second electrode may be shifted toward a polarity which is opposite to a charge polarity of the recording particles. Alternatively, in correspondence with turning off of the first voltage applied to the first electrode, a potential of the back electrode may be shifted toward the same polarity as a charge polarity of the recording particles, or, in correspondence with turning off of the first voltage applied to the first electrode, a potential of the second electrode may be shifted toward a polarity which is opposite to a charge polarity of the recording particles and a potential of the back electrode may be shifted toward the same polarity as the charge polarity of the recording particles.

The other direct recording apparatus of the present invention comprises:

a carrier which holds charged recording particles;

a back electrode which is opposed to the carrier to electrostatically attract the recording particles;

a PC board which is placed between the carrier and the back electrode so as to form a passage through which an image carrier passes between the back electrode and the PC board, the PC board being made of an insulating material and having a plurality of apertures through which the recording particles can pass;

a first electrode which is placed around each of the apertures in the PC board, and which, when the first voltage is applied, more strongly attracts the recording particles held on the carrier toward the back electrode and causes them to jump into the aperture; and a control section which, in correspondence with turning off of the first voltage applied to the first electrode, controls a potential of the back electrode to be shifted toward the same polarity as a charge polarity of the recording particles.

According to the direct recording apparatus of the present invention, in correspondence with turning off of the first voltage applied to the first electrode, the control section controls the potential difference between the second electrode and the back electrode so as to become smaller, and hence the electric field formed between the PC board and the back electrode is weakened. When toner particles which have jumped from the carrier and passed through the aperture of the PC board enter the weakened electric field, therefore, the acceleration is suppressed and the speed of the toner particles becomes lower than that in the related art, so that the impact at the collision with the image carrier is reduced. As a result, the toner particles are prevented from scattering on the image carrier, and it is therefore possible to record a sharp and high quality image.

In the other direct recording apparatus of the present invention, similarly, in correspondence with turning off of the first voltage applied to the first electrode, the control section controls the potential of the back electrode so as to be shifted toward the same potential as the charge polarity of the recording particles, and hence the electric field which electrostatically attracts toner particles jumping from the carrier is weakened. Therefore, the acceleration of the jumping toner particles is suppressed and the speed of the toner particles is lower than that in the related art, so that the impact at the collision with the image carrier is reduced. As a result, the toner particles are prevented from scattering on the image carrier, and it is therefore possible to record a sharp and high quality image.

BRIEF DESCRIPTION OF THE DRAWINGS

The present invention will be further described with reference to the accompanying drawings wherein like reference numerals refer to like parts in the several views, and wherein.

DESCRIPTION OF THE PREFERRED EMBODIMENTS

Figure 1:
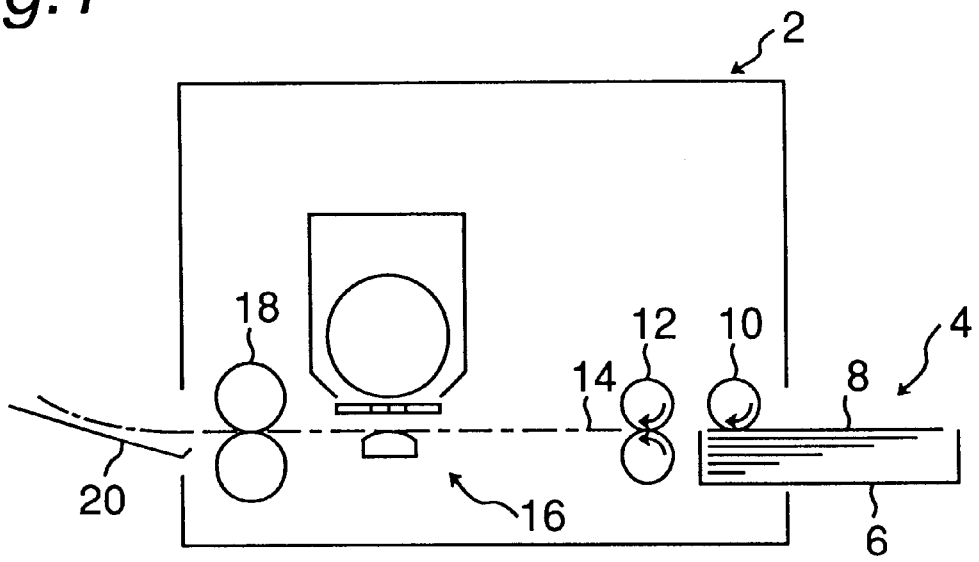
FIG. 1 is a schematic view showing the configuration of a direct recording apparatus of a preferred embodiment.

FIG. 1 shows the direct recording apparatus of the present invention which is generally indicated by the reference numeral 2. The recording apparatus 2 has a sheet supply station which is generally indicated by the reference numeral 4. The sheet supply station 4 has a detachable cassette 6 in which sheets (image carriers) 8 such as paper sheets are housed in a stacked manner. A sheet supply roller 10 is placed above the cassette 6, and rotated with making contact with the uppermost sheet 8 so as to feed the sheet 8 into the recording apparatus 2. A pair of timing rollers 12 are placed in the vicinity of the sheet supply roller 10. The timing rollers 12 supplies the sheet 8 fed from the cassette 6, along a sheet passage 14 indicated by the one-dot chain line into a recording station (which is generally indicated by the reference numeral 16) for forming an image consisting of recording particles on the sheet 8. The recording apparatus 2 has also a fixing station 18 for permanently fixing the image of recording particles onto the sheet 8, and a final stacking station 20 for housing the sheet 8 onto which the image of recording particles is fixed.

Figure 2:
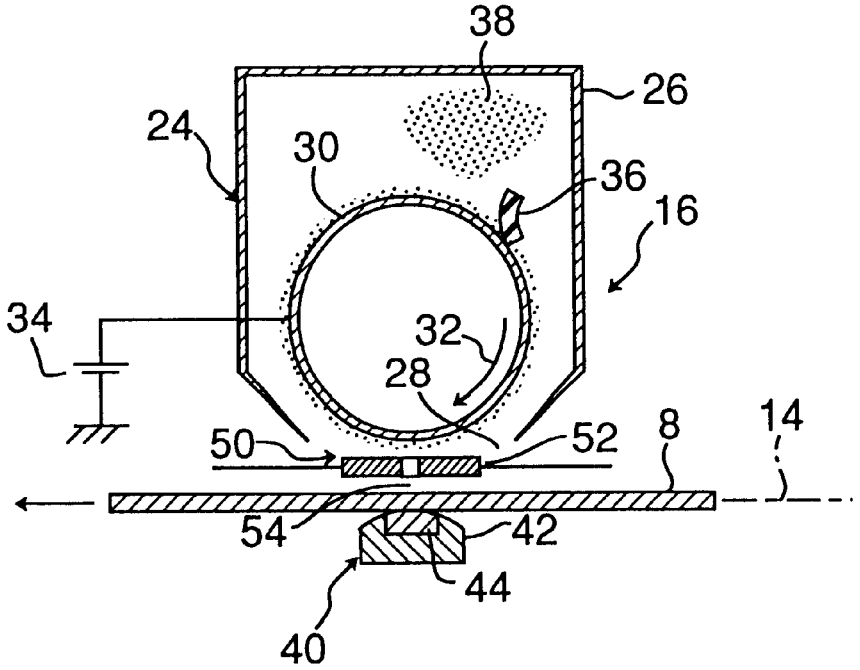
FIG. 2 is a schematic section view of a recording station.

Referring to FIG. 2, the recording station 16 has above the sheet passage 14, a recording particle supply section which is generally indicated by the reference numeral 24. The recording particle supply section 24 has a container 26 in which an opening 28 opposed to the sheet passage 14 is formed. In the vicinity of the opening 28, a record roller (carrier) 30 is supported so as to be rotatable in the direction of the arrow 32. The record roller 30 is made of a conductive material, and grounded via a DC power source 34. A blade 36 is preferably formed by a plate made of rubber or stainless steel, and placed so as to make contact with the record roller 30.

It is to be noted that the record roller 30 may be directly grounded without passing through the DC power source 34.

The container 26 houses recording particles, i.e., toner particles 38. The toner particles 38 are supplied to the outer peripheral surface of the record roller 30 by a supply roller (not shown) disposed in the container 26, and then transported in accordance with rotation of the record roller 30. Subsequently, the toner particles 38 held on the record roller 30 are transported to an area where the record roller 30 and the blade 36 are contacted with each other. In the area, the toner particles 38 are frictionally contacted with the blade 36 to be charged into a predetermined polarity. In the embodiment, toners which are charged into a negative polarity are used as the toner particles 38. Therefore, the outer peripheral surface of the record roller 30 which has passed through the contact area between the record roller 30 and the blade 36 holds the toner particles 38 which are negatively charged, in a state of a uniform thin layer. As illustrated in FIG. 2, a voltage of a positive polarity is supplied from the power source 34 to the record roller 30, so that the toner particles 38 which are negatively charged are electrostatically deposited to the record roller 30. In the case where the record roller 30 is directly grounded, the toner particles 38 are held on the record roller 30 by the image force.

Figure 3:
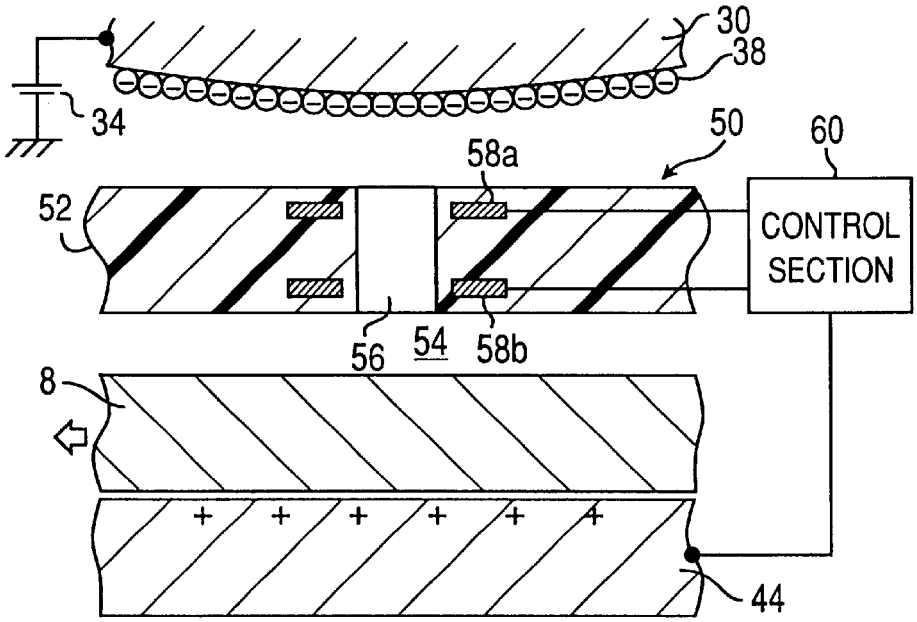
FIG. 3 is a partial enlarged view of a PC board, a record roller, and a back electrode in the case where a thin toner particle layer is carried on the record roller.

An electrode mechanism which is generally indicated by the reference numeral 40 is placed beyond the sheet passage 14 and below the recording particle supply section 24. The electrode mechanism 40 has a support 42 made of an insulating material, and a back electrode 44 made of a conductive material. As shown in FIG. 3, the back electrode 44 is connected to a control section 60 which supplies a voltage of a predetermined polarity (in the embodiment, the positive polarity) to the electrode, so that the negatively charged toner 38 on the record roller 30 is electrostatically attracted toward the back electrode 44. However, the voltage which is applied from the control section 60 to the back electrode 44 is set to a level at which the strength of the electric field generated between the back electrode 44 and the record roller 30 is insufficient for causing the toner particles 38 held on the record roller 30 to jump.

As shown in FIG. 2, a PC board which is generally indicated by the reference numeral 50 is fixed between the recording particle supply section 24 and the electrode mechanism 40 and above the sheet passage 14. Preferably, the PC board 50 is configured by a flexible printed circuit board 52 made of an insulating material and having a thickness of about 100 to 200 $\mu$m. As shown in FIGS. 2 and 3, the portion of the PC board 50 located in a recording zone 54 where the record roller 30 is opposed to the back electrode 44 has a plurality of apertures 56 having an inner diameter of about 25 to 200 μm which is substantially larger than the mean particle diameter of the toner particles 38 (from about several to a dozen micrometers). The apertures 56 are uniformly arranged at predetermined intervals in a direction perpendicular to the sheet transport direction.

As shown in FIG. 3, the PC board 50 has annular first and second electrodes 58*a* and 58*b* around the respective apertures 56.. In the PC board 50, the first electrode 58*a* is placed in the vicinity of the surface which is opposed to the record roller 30, and the second electrode 58*b* is placed on the side of the back electrode 44 with respect to the first electrode 58*a*. The first and second electrodes 58*a* and 58*b* are connected to the control section 60, so that a predetermined voltage is applied from the control section 60 to the electrodes 58*a* and 58*b*, respectively.

Next, the operation of the recording apparatus 2 will be described. As shown in FIG. 2, in the recording particle supply section 24, the record roller 30 is rotated in the direction of the arrow 32. The toner particles 38 are supplied to the record roller 30 to be transported to the contact area between the blade 36 and the record roller 30. In the area, negative electrostatic charges are given to the toner particles 38 by means of friction with the blade 36. As a result, as shown in FIG. 3, the outer peripheral surface of the record roller 30 which has passed through the contact area holds the charged toner particles 38 in a state of a uniform thin layer.

Figure 5A:
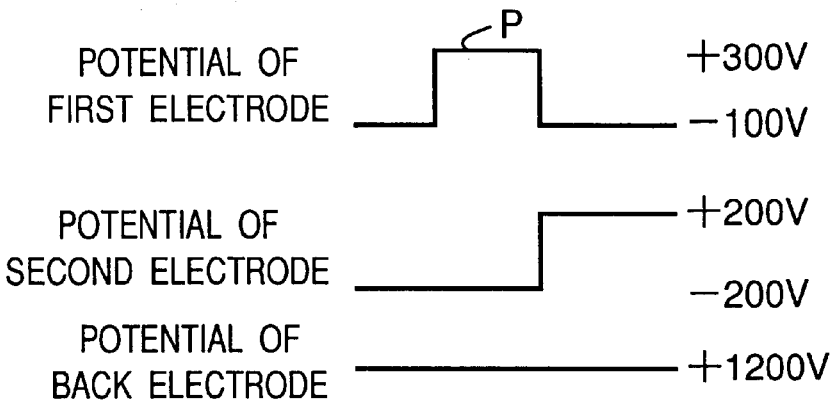
FIGS. 5A to 5C are views showing the control state of the potentials of a first electrode, a second electrode, and the back electrode.

During the non-image forming period, as shown in FIG. 5A, a base voltage of, for example, −100 volts is applied to the first electrode 58*a*, and a base voltage of, for example, −200 volts is applied to the second electrode 58*b*. A constant voltage of, for example, +1,200 volts is applied to the back electrode 44. At this time, as shown in FIG. 3, the negatively charged toner particles 38 on the record roller 30 and electrically repelled from the first and second electrodes 58*a* and 58*b* to be stably kept held on the record roller 30 without being caused to jump toward the aperture 56.

Figure 4:
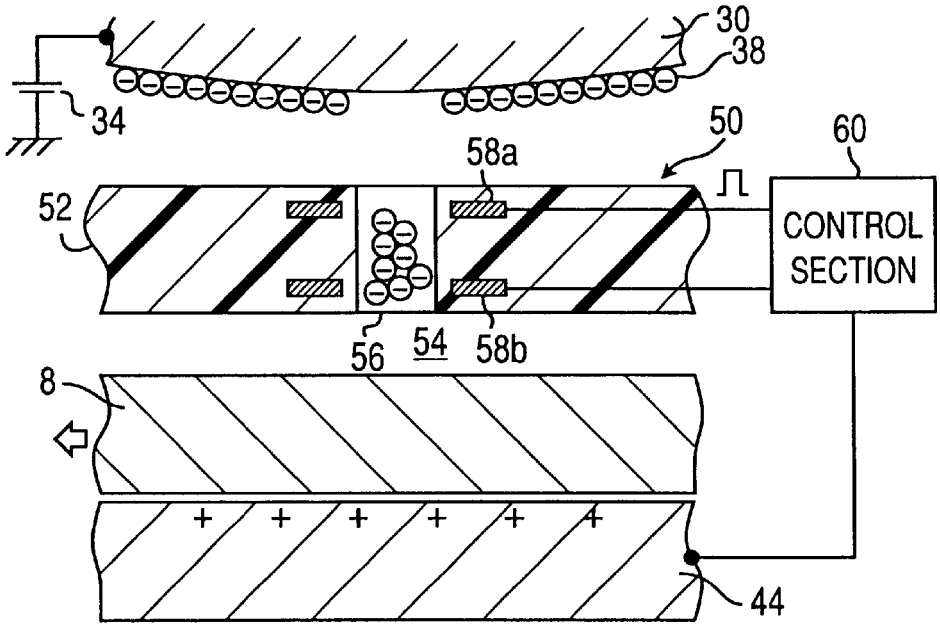
FIG. 4 is a partial enlarged view of the PC board, the record roller, and the back electrode in the case where toner particles are jumping from the record roller into an aperture of the PC board.

During the recording period, as shown in FIG. 5A, a pulse voltage P of, for example, +300 volts is applied from the control section 60 to the first electrode 58*a* in accordance with the image to be formed. Consequently, as shown in FIG. 4, the negatively charged toner particles 38 that are held in the position on the record roller 30 where is opposed to the first electrode 58*a* to which the pulse voltage P is applied are electrostatically attracted in a further enhanced manner by means of the attractive force exerted by the first electrode 58*a* and the back electrode 44, and peeled off from the record roller 30 to jump toward the corresponding aperture 56.

A cluster of the toner particles 38 which enter the interior of the aperture 56 is subjected to an electric repulsive force by the second electrode 58*b* to which the voltage of −200 volts and having the same polarity as the toner particles 38 is applied, to be inwardly converged in a radial direction. In substantial synchronism with the passing of the cluster of the converged toner particles 38 through the aperture 56, the pulse voltage P applied to the first electrode 58*a* is turned off, so that the voltage applied to the first electrode 58*a* is returned to the base voltage of −100 volts. As a result, the toner particles 38 stop jumping from the record roller 30.

In correspondence with turning off of the first electrode 58*a*, the control section 60 controls the potential difference between the second electrode 58*b* and the back electrode 44 to become smaller. Specifically, as shown in FIG. 5A, in synchronism with the turning off of the pulse voltage P for causing the recording particles to jump which is applied to the first electrode 58*a*, the potential of the second electrode 58*b* is shifted toward a polarity which is opposite to the negative polarity of the recording particles 38, i.e., toward the positive polarity, so as to be set to, for example, +200 volts. As a result, the electric field formed between the PC board 50 and the back electrode 44 is weakened. When the toner particles 38 which have passed through the aperture 56 enter the weakened electric field, the acceleration is suppressed.

Figure 6:
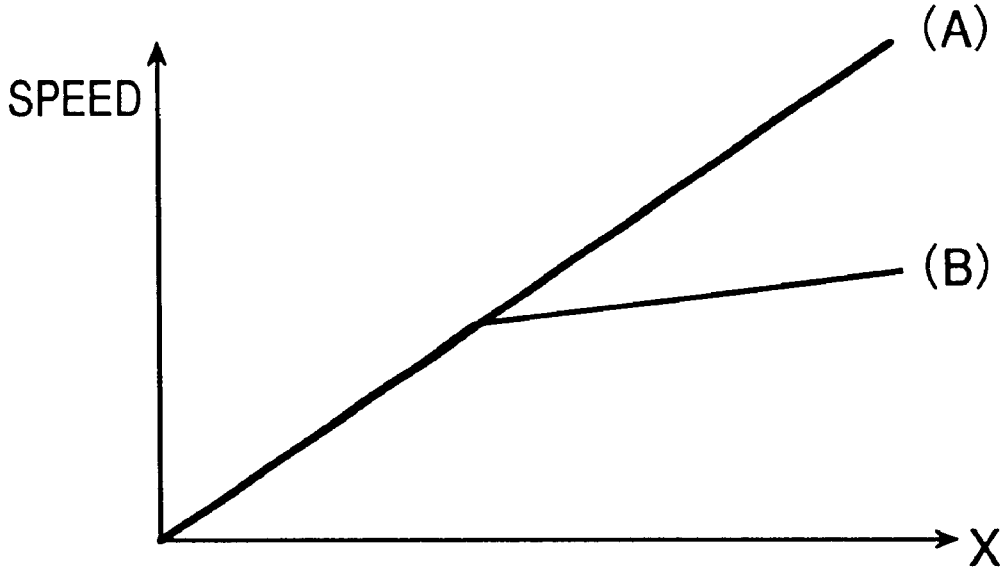
FIG. 6 is a graph showing relationships between the distance X from the record roller in the direction toward the back electrode, and the jumping speed of toner particles.

FIG. 6 is a graph showing relationships between the distance X from the record roller 30 in the direction toward the back electrode 44, and the jumping speed of the toner particles 38. When the voltage applied to the second electrode 58*b* is made constant as in the related art, the speed of the toner particles 38 tends to be increased in proportion to the distance X as indicated by (A) in the graph. By contrast, in the case where the voltage applied to the second electrode 58*b* is switched over in the manner described above in substantial synchronism with the passing of the toner particles 38, when the toner particles 38 enter the weakened electric field, the acceleration is suppressed so that the jumping speed becomes lower than that in the related art as indicated by (B) in the graph. As a result, the impact at the collision of the toner particles 38 with the sheet 8 transported into the recording zone 54 is reduced, so that the toner particles 38 are prevented from scattering on the sheet 8. Therefore, a cluster of the converged toner particles 38 are deposited on the sheet 8 without scattering the toner particles, so that a dense dot having a sharp outline can be formed. Consequently, a sharp and high quality image can be recorded.

It is to be noted that, before the next pulse voltage P is applied to the first electrode 58*a*, the potential of the second electrode 58*b* is switched from +200 volts to the base voltage of −200 volts.

The sheet 8 on which the image is recorded by the toner particles 38 is transported to the fixing station 18. In the station, the toner particles 38 are heated to be permanently fixed to the sheet 8. Finally, the sheet 8 is discharged into the stacking station 20.

Figure 5B:
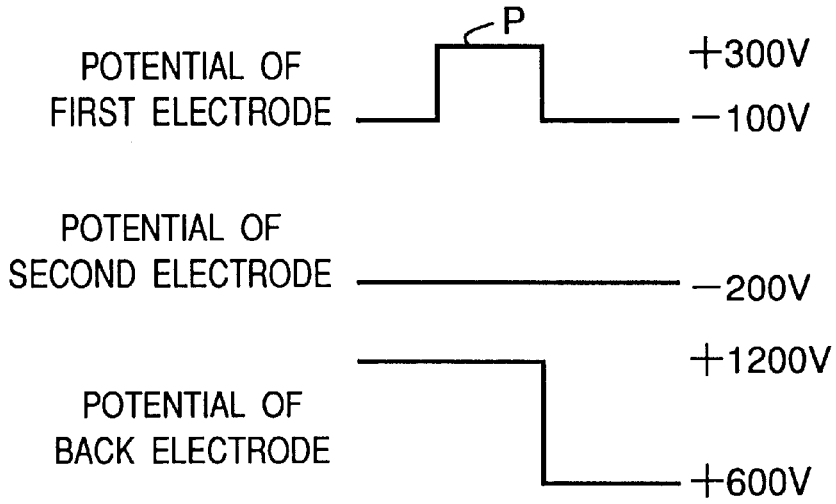

In the recording apparatus 2 described above, the voltage applied to the second electrode 58*b* is switched over in order to prevent the toner from scattering on the sheet 8. Alternatively, in order to attain the same effect, the potential of the second electrode 58*b* may be set to have a constant vale of, for example, −200 volts, and the potential of the back electrode 44 may be switched over by the control section 60. Specifically, as shown in FIG. 5B, in synchronism with the turning off of the pulse voltage P of the first electrode 58*a*, the potential of the back electrode 44 is shifted toward the same polarity as the charge polarity of the toner particles 38, i.e., toward the negative polarity, so as to be switched from +1,200 volts to, for example, +600 volts. In this method also, the electric field formed between the PC board 50 and the back electrode 44 can be weakened, and the acceleration of the toner particles 38 is suppressed, whereby the toner scattering on the sheet 8 is prevented from occurring. This method in which the potential of the back electrode 44 is controlled so as to prevent the toner scattering on the sheet 8 from occurring may be applied also to a recording apparatus having the same configuration as that of the recording apparatus 2 except that the second electrode 58*b* is omitted.

Figure 5C:
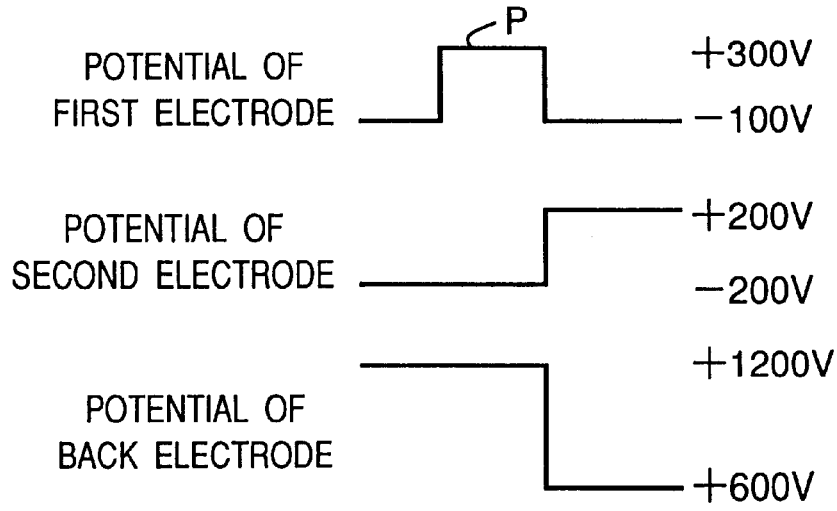

In order to prevent the toner scattering on the sheet 8 from occurring, the potential controls of the second electrode 58*b* and the back electrode 44 which are performed by the control section 60 may be combined with each other. Namely, in correspondence with the turning off of the voltage for jumping of the toner particles which is applied to the first electrode 58*a*, the potential of the second electrode 58*b* may be shifted toward a polarity which is opposite to the charge polarity of the recording particles 38, and the potential of the back electrode 44 may be shifted toward the same polarity as the charge polarity of the recording particles 38. Specifically, as shown in FIG. 5C, in synchronism with the turning off of the pulse voltage P applied to the first electrode 58*a*, the potential of the second electrode 58*b* is switched from, for example, −200 volts to +200 volts, and that of the back electrode 44 is switched from, for example, +1,200 volts to +600 volts. As a result, the electric field formed between the PC board 50 and the back electrode 44 is weakened to a lower degree, so that the effect of preventing the toner scattering from occurring on the sheet 8 can be further ensured.

In the above, the configurations in which the potential of the second electrode 58*b* and/or the back electrode 44 is switched over in complete synchronization with the turning off of the pulse voltage P applied to the first electrode 58*a* have been described. Alternatively, the timing of switching the potential of the second electrode 58*b* and/or the back electrode 44 may be slightly shifted from the timing of turning off the pulse voltage P of the first electrode 58*a*.

In the recording apparatus 2, the toner particles 38 are directly deposited on the sheet 8 to record an image. Alternatively, the image carrier may be formed as an intermediate transfer member of, for example, a belt-like or drum-like shape, a toner image may be once formed on the intermediate transfer member, and the toner image may be then transferred onto a recording sheet such as a paper sheet.

The invention may be applied also to a recording apparatus in which the second electrode is split into two electrodes in a direction that is substantially perpendicular to the sheet transport direction, and which performs a control (the so-called dot deflection control) wherein the two split electrodes are independently turned on or off to change the jumping direction of a cluster of the toner particles passing through the aperture 56 so that two or three dots are selectively formed by a single aperture 56.

The configuration of the recording particle supply section 24 is not restricted to the above-described one. In place of the recording particle supply section, a developing device of any kind which is employed in an electrophotographic image forming apparatus can be used.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included thereto.

What is claimed is:

1. A direct recording apparatus comprising:

a carrier which holds charged recording particles;

a back electrode which is opposed to said carrier to electrostatically attract said recording particles;

a PC board which is placed between said carrier and said back electrode so as to form a passage through which an image carrier passes between said back electrode and said PC board, said PC board being made of an insulating material and having a plurality of apertures through which said recording particles can pass;

a first electrode which is placed around each of said apertures in said PC board, and which, when a first voltage is applied, more strongly attracts said recording particles held on said carrier toward said back electrode and causes said recording particles to jump into said aperture;

a second electrode which is placed around each of said apertures in said PC board and on the side of said back electrode with respect to said first electrode, and which, when a second voltage is applied, causes a cluster of said recording particles passing through said aperture to converge by an electric repulsive force, or changes a jumping direction of a cluster of said recording particles passing through said aperture; and a control section which, in correspondence with turning off of the first voltage applied to said first electrode, controls a potential difference between said second electrode and said back electrode such that the potential difference becomes smaller for reducing the acceleration of the recording particles toward the back electrode.

2. A direct recording apparatus according to claim 1, wherein, in correspondence with turning off of said first voltage applied to said first electrode, a potential of said second electrode is shifted toward a polarity which is opposite to a charge polarity of said recording particles.

3. A direct recording apparatus according to claim 1, wherein, in correspondence with turning off of said first voltage applied to said first electrode, a potential of said back electrode is shifted toward a polarity that is the same as a charge polarity of said recording particles.

4. A direct recording apparatus according to claim 1, wherein, in correspondence with turning off of said first voltage applied to said first electrode, a potential of said second electrode is shifted toward a polarity which is opposite to a charge polarity of said recording particles, and a potential of said back electrode is shifted toward the same polarity as said charge polarity of said recording particles.

5. A direct recording apparatus comprising:

a carrier which holds charged recording particles;

a back electrode which is opposed to said carrier to electrostatically attract said recording particles;

a PC board which is placed between said carrier and said back electrode so as to form a passage through which an image carrier passes between said back electrode and said PC board, said PC board being made of an insulating material and having a plurality of apertures through which the recording particles can pass;

a first electrode which is placed around each of said apertures in said PC board, and which, when a first voltage is applied, more strongly attracts said recording particles held on said carrier toward said back electrode and causes said recording particles to jump into said aperture; and a control section which, in correspondence with turning off of said first voltage applied to said first electrode, controls a potential of said back electrode such that the potential is shifted toward a polarity that is the same as a charge polarity of said recording particles to reduce the acceleration of said recording particles toward the back electrode.

* * * * *